US007182514B2

(12) United States Patent
Schreiter

(10) Patent No.: US 7,182,514 B2
(45) Date of Patent: Feb. 27, 2007

(54) RESEALABLE CLOSURE MECHANISM HAVING A SLIDER DEVICE AND METHODS

(75) Inventor: Michael E. Schreiter, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 11/198,737

(22) Filed: Aug. 5, 2005

(65) Prior Publication Data

US 2006/0029301 A1 Feb. 9, 2006

Related U.S. Application Data

(62) Division of application No. 10/464,700, filed on Jun. 18, 2003, now Pat. No. 6,948,849, which is a division of application No. 09/725,977, filed on Nov. 29, 2000, now Pat. No. 6,679,027.

(51) Int. Cl.
*B65D 33/16* (2006.01)
*A44B 19/16* (2006.01)

(52) U.S. Cl. ..... 383/64; 24/399; 24/400

(58) Field of Classification Search ..... 383/64; 24/30.5 R, 399, 400, 585.12
See application file for complete search history.

(56) References Cited

U.S. PATENT DOCUMENTS

| | | | |
|---|---|---|---|
| 2,909,822 | A | 10/1959 | Botti et al. |
| 3,074,137 | A | 1/1963 | Hawley |
| 3,173,184 | A | 3/1965 | Ausnit |
| 3,220,076 | A | 11/1965 | Ausnit |
| 3,259,951 | A | 7/1966 | Zimmerman |
| 3,579,747 | A | 5/1971 | Hawley |
| 3,660,875 | A | 5/1972 | Gutman |
| 3,790,993 | A | 2/1974 | Gilles et al. |
| 4,812,056 | A | 3/1989 | Zieke |
| 4,944,072 | A | 7/1990 | Robson |
| 5,007,143 | A | 4/1991 | Herrington |
| 5,664,299 | A | 9/1997 | Porchia et al. |
| 5,689,866 | A | 11/1997 | Kasai et al. |
| 5,809,621 | A | 9/1998 | McCree et al. |
| 5,896,627 | A | 4/1999 | Cappel et al. |
| 5,953,796 | A | 9/1999 | McMahon et al. |
| 6,439,771 | B1 | 8/2002 | Herrington, Jr. |
| 6,491,432 | B2 | 12/2002 | May |
| 6,581,253 | B2 | 6/2003 | ErkenBrack |
| 6,679,027 | B2 | 1/2004 | Schreiter |

FOREIGN PATENT DOCUMENTS

| | | |
|---|---|---|
| WO | WO 92/17085 | 10/1992 |

*Primary Examiner*—Jes F. Pascua
(74) *Attorney, Agent, or Firm*—Merchant & Gould P.C.

(57) ABSTRACT

A slider device having contoured top and sidewalls is disclosed for use with a resealable package. In a first embodiment, the slider device includes an engagement structure for engaging and interlocking first and second closure profiles of a resealable closure mechanism. The engagement structure includes a first protrusion and a second protrusion depending from the top wall of the slider device for engaging first and second closure profiles of a resealable closure mechanism. The first and second protrusions selectively open and close the resealable closure mechanism as the slider device is moved from a first position to a second position. In a second embodiment, a slider device is disclosed having first and second slide channels that engage first and second closure profiles. The first and second slide channels selectively open and close the resealable closure mechanism as the slider device is moved from a first position to a second position.

10 Claims, 12 Drawing Sheets

RESEALABLE CLOSURE MECHANISM HAVING A SLIDER DEVICE AND METHODS

CROSS REFERENCE TO RELATED APPLICATION

This application is a divisional application of and claims the priority of U.S. application Ser. No. 10/464,700, filed Jun. 18, 2003 now U.S. Pat. No. 6,948,849, which in turn is a divisional application and claims the priority of U.S. application Ser. No. 09/725,977, filed Nov. 29, 2000, now U.S. Pat. No. 6,679,027, each of which is incorporated herein by reference in its entirety.

FIELD OF THE INVENTION

This disclosure generally relates to closure arrangements for polymer packages, such as, plastic bags. In particular, this disclosure relates to resealable closure mechanisms or zipper-type closures for resealable packages.

BACKGROUND OF THE INVENTION

Many packaging applications use resealable containers to store or enclose various types of articles and materials. These packages may be used to store food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. In some instances, providing products in resealable packages appreciably enhances the marketability of those products.

Some types of resealable packages are opened and closed using a slider device. The slider device typically includes a separator or spreader-type structure at one end that opens a closure mechanism, having profiled elements or closure profiles, when the slider device travels in a first direction along the mechanism. The sidewalls of the slider device are configured so that the sidewalls engage the closure profiles and progressively move them into engagement to close the resealable package when the slider device is moved along the closure mechanism in a direction opposite the first direction.

Improvements in the design and manufacture of closure mechanisms and slider devices are desirable.

SUMMARY OF THE INVENTION

In general terms, this disclosure relates to resealable closure mechanisms having slider devices operably mounted thereon for selectively opening or closing the resealable closure mechanism. In one aspect, a slider device having contoured top and sidewalls is disclosed for use with a resealable closure mechanism having a first closure profile and a second closure profile. One embodiment of a slider device includes an engagement structure for engaging and interlocking first and second closure profiles of a resealable closure mechanism. For example, the slider device includes a top wall having a first protrusion integral with the top wall at a first end of the slider device and a second protrusion integral with the top wall at a second end of the slider device. The first and second protrusions are constructed and arranged to engage the first and second closure profiles to selectively open and close the resealable closure mechanism as the slider device is moved from a first position to a second position.

The disclosure also concerns a reclosable zipper arrangement. In one embodiment described, the zipper arrangement includes a first closure profile defining a first closure member having an upper latching portion and a lower latching portion. The first closure profile also includes a locking finger. The zipper arrangement also includes a second closure profile having a second closure member with a catch. A slider device is provided to engage the locking finger such that the lower latching portion of the first catch interlocks with the second catch of the second closure member when said slider device is selectively moved along the resealable closure mechanism in a first direction.

In a second embodiment, a second slider device includes a top wall, a first and second sidewall depending from the top wall. The first and second sidewalls define slide channels that receive and engage the first and second closure profiles to selectively open and close a resealable closure mechanism as the slider device is moved from a first position to a second position.

A second embodiment of a resealable closure mechanism operable with the second slider device is also disclosed. In the second embodiment, the zipper arrangement includes a first closure profile defining a first closure member having a catch, and a lever or flange member cantilevered from the first closure profile opposite the first closure member. The zipper arrangement also includes a second closure profile defining a second closure member, and a lever or flange member cantilevered from the second closure profile opposite the second closure member. The slide channels of the slider device receive and engage the flange members of the first and second closure profiles such that the first and second closure members interlock when the slider device is moved in a first direction and disengage when the slider device is moved in a second direction.

Methods of using a resealable package are described. Methods include a step of moving a slider device along a mouth a first direction from a side seal of the resealable package such that the contoured top and sidewalls of the slider device engage the first and second closure profiles of the resealable closure mechanism. Packages and slider devices as described herein may be usable in this method.

DETAILED DESCRIPTION OF PREFERRED EMBODIMENTS

Figure 1:
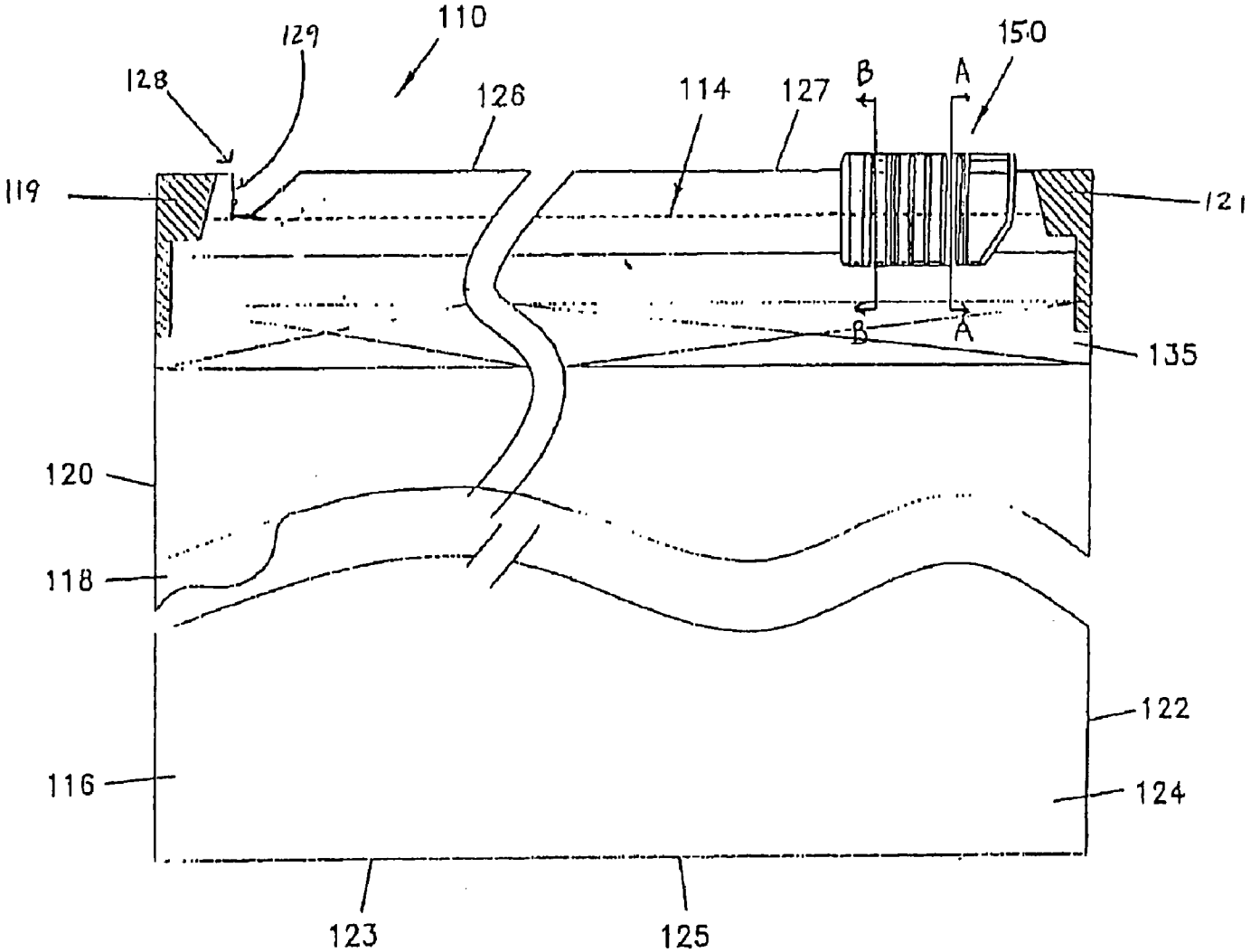
FIG. 1 is a side elevational, schematic view of a flexible, resealable package having a slider device, according to principles of this disclosure.

Attention is directed to FIG. 1. FIG. 1 illustrates an example packaging arrangement in the form of a resealable, flexible package 110, for example, a polymeric package such as a plastic bag, having a resealable closure mechanism 114, for example, interlocking profiled elements, constructed in accordance with the principles of this disclosure. The flexible package 110 includes first and second opposed panel sections 116, 118, typically made from a flexible, polymeric, plastic film. With some manufacturing applications, the first and second panel sections 116, 118 are heat-sealed together along two side edges 120, 122 and meet at a fold line 123 in order to form a three-edged containment section for a product within an interior 124 of the package 110. In the embodiment shown, the fold line 123 comprises the bottom edge 125 of the package 110. Alternatively, two separate panel sections 116, 118 of plastic film may be used and heat-sealed together along the two side edges 120, 122 and at the bottom edge 125. Access is provided to the interior 124 of the package 110 through a mouth 126 at a top edge 127 of the package. In the particular embodiment shown, the mouth 126 extends the width of the package 110.

The resealable closure mechanism 114 is illustrated in FIG. 1 at the mouth 126 of the flexible package 110. In the embodiment shown, the resealable closure mechanism 114 extends the width of the mouth 126. Alternatively, the closure mechanism 114 could be positioned on the package 110 at a location different from the mouth 126 of the package 110, depending on the application needs for the package 110. The resealable closure mechanism 114 can be one of a variety of closure mechanisms. In the particular embodiment illustrated in FIG. 2, the resealable closure mechanism 114 is shown in the specific form of a zipper-type closure mechanism. By the term "zipper-type closure mechanism," it is meant a structure having opposite interlocking or mating profiled elements that under the application of pressure will interlock and close the region between the profiles.

A slider device 150 is operably mounted on the resealable closure mechanism 114 for selectively opening and closing the resealable closure mechanism 114. The slider device 150 is constructed and arranged to cooperate with the resealable closure mechanism 114. For example, the slider device 150 can have contoured top and sidewalls that engage or interface with the interlocking or mating profiled elements of the resealable closure mechanism 114 to selectively open or close the flexible package 110. By "engage," it is meant that the contoured walls of the slider device 150 apply pressure to interlocking or mating profiled elements of the resealable closure mechanism 114 that will interlock and close the region between the profiles. Alternatively, the contoured walls of the slider device 150 can apply pressure to the interlocking or mating profiled elements of the resealable closure mechanism 114 to disengage the profiles.

Figure 2:
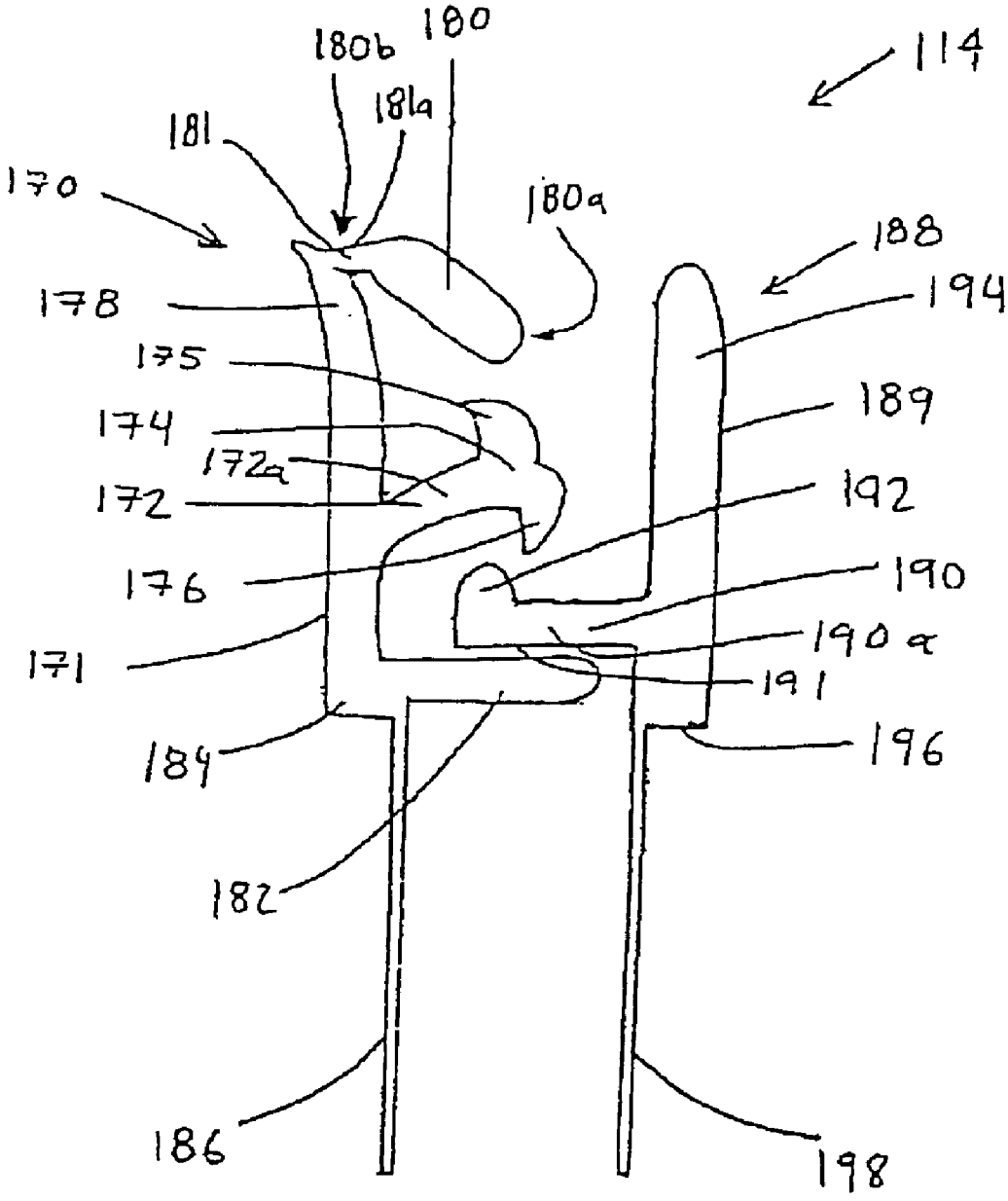
FIG. 2 is a cross-sectional view of a first embodiment of profiled elements usable with the resealable package of FIG. 1, according to principles of this disclosure.

While many embodiments of slider devices 150 having contoured top and sidewalls for engaging and interfacing with the resealable closure mechanism 114 are contemplated, one particular embodiment will be described in connection with FIGS. 2 through 8. In particular, the zipper-type closure mechanism shown in FIG. 2 is an illustration of one example of a closure mechanism 114. The closure mechanism 114 includes an elongated first closure profile 170 and an elongated second closure profile 188. Typically, the closure profiles 170, 188 are manufactured separately from each other.

Still in reference to FIG. 2, the preferred first closure profile 170 depicted includes a sealing flange or bonding strip 186, a base strip 171, a first closure member 172, a first guidepost 182, and an upper flange 178. The closure member 172 extends from the base strip 171 by way of a stem 172*a* and is generally projecting from the base strip 171. At a free end of the stem 172*a* (the tip of the closure member 172) is a hook or catch 174. The hook or catch 174 has an upper latching portion 175 and a lower latching portion 176. The first closure profile 170 also includes a locking finger 180 extending from the upper flange 178 of the base strip 171. The locking finger 180 has a distal portion 180*a*, a proximal portion 180*b*, and a neck portion 181. By "distal," it is meant to refer to the portion of the locking finger 180 farthest from its point of attachment (the neck portion 181). By "proximal," it is meant to refer to the portion of the locking finger 180 closest to the point of connection with the upper flange 178. Note that the neck portion 181 is between and bridges the base strip 171 and the distal portion 180*a*. In preferred embodiments, the neck portion 181 is tapered or narrows inwardly at taper 181*a* between the base strip 171 and the distal portion 180*a*. The taper 181*a* helps to provide flexibility to the locking finger 180. Also, as will be described below, the taper 181*a* provides a track or groove for slidable engagement with the engagement structure 162 on the slider device 150.

The guidepost 182 extends from and is generally projecting from the base strip 171. The guidepost 182 aids in holding the closure mechanism 114 closed and in aligning the first closure profile 170 with the second closure profile 188 for interlocking. The bonding strip 186 depends or extends downward from the guidepost 182 and can be attached to a first panel section, such as the first panel section 116 of the package 110 of FIG. 1 at region 135 (FIG. 1). A first shoulder 184 is defined by the intersection of the base strip 171 and bonding strip 186. In the example illustrated, the bonding strip 186 is spaced a distance laterally from the base strip 171 to define a corner forming the shoulder 184. The upper flange 178 extends upwardly from the base strip 171 and the guidepost 182.

The preferred second closure profile 188 depicted includes a bonding strip 198, a base strip 189, a first closure member 190, and an upper flange 194. The closure member 190 extends from the base strip 189 by way of a stem 190*a* and is generally projecting from the base strip 189. At a free end of the stem 190*a* (or tip of the closure member 190) is a hook or catch 192. The lower surface 191 of the closure member 190 aids in holding the closure mechanism 114 closed and aids in aligning the second closure profile 188 with the first closure profile 170 for interlocking. The bonding strip 198 depends or extends downward from the base strip 189 and can be attached to a second panel section, such as the second panel section 118 of the package 110 of FIG. 1. A shoulder 196, analogous to the shoulder 184, is formed at the corner of the bonding strip 198 and the base strip 189.

The first and second closure profiles 170, 188 are designed to engage with one another to form the resealable closure mechanism 114. The closure member 172 of the first closure profile 170 extends from the base strip 171 a first distance. The closure member 190 of the second closure profile 188 also extends from the base strip 189 a first distance. These first distances that the closure members 170, 188 extend are sufficient to allow mechanical engagement, or interlocking, between the first closure member 172 of the first closure profile 170 and the first closure member 190 of the second closure profile 188. Therefore, the catches 174, 192 are allowed to hook or engage each other. In particular, the lower latching portion 176 of the catch 174 of the first closure member 172 is allowed to hook or engage the catch 192 of the second closure profile 188. Furthermore, the closure profiles 170, 188 are sealed together at their ends, such as regions 119, 121 of FIG. 1, to further aid in aligning the closure profiles 170, 188 for interlocking through processes such as ultrasonic crushing.

The openable sealed closure mechanism 114 is formed by pushing the locking finger 180 downward into engagement with the upper latching portion 175 of the first closure member 172 such that the first closure member 172 interlocks with the second closure member 190. Conversely, the locking finger 180 can be pushed out of engagement with the upper latching portion 175 of the first closure member 172 such that the first closure member 172 disengages from the second closure member 190, thereby, opening the package 110 of FIG. 1. This provides access to the contents of the package 110 through the mouth 126 (FIG. 1).

In some applications, the closure profiles 170, 188 are formed by two separate extrusions or through two separate openings of a common extrusion. Typically, the resealable closure mechanism 114 is made of conventional materials, such as a polymeric, plastic material, for example, polyethylene or polypropylene. In one example embodiment, the closure arrangement illustrated in FIG. 2 is manufactured using conventional extrusion and heat-sealing techniques.

Attention is again directed to FIG. 1. In FIG. 1, note that there is a cutout or notch 128 formed in the upper flanges 139, 147 (FIG. 2) of the resealable closure mechanism 114. The notch 128 serves as a "parking place" for a slider device 150 and also facilitates mounting the slider device 150 onto the resealable package 110 during initial assembly. In addition, the edge 129 closest to the side seal 120 helps to create a stop member for the slider device 150. The notch 128 decreases the tendency for an incomplete interlock between the first closure profile 170 and the second closure profile 188.

Figure 3:
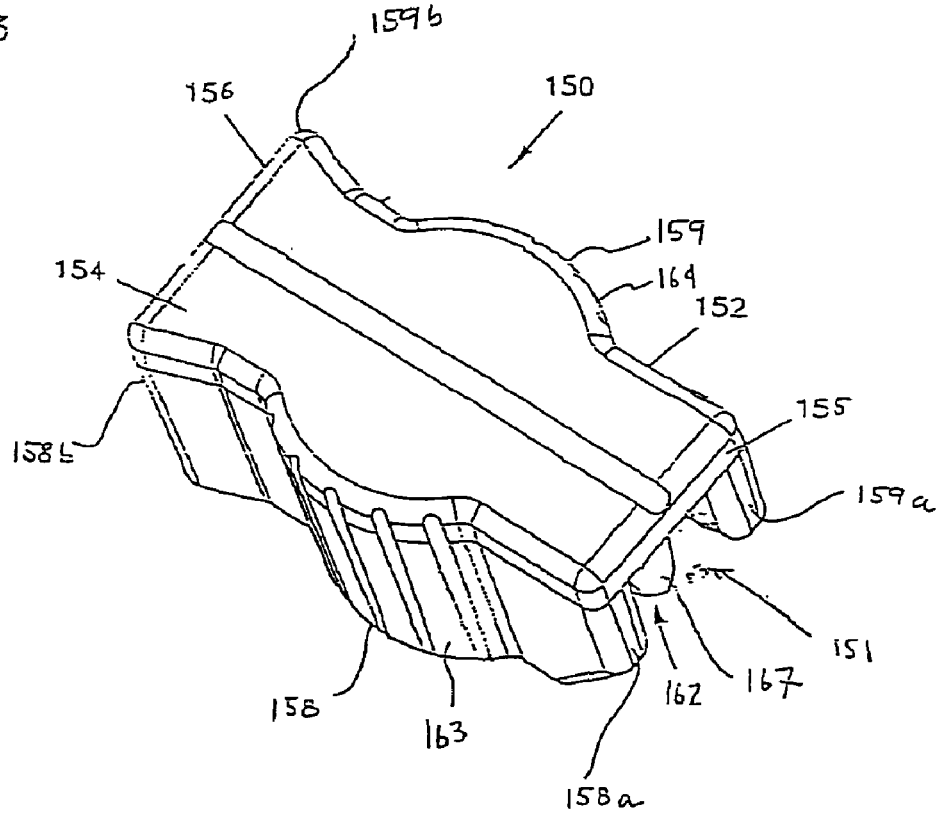
FIG. 3 is an enlarged, top perspective view of one embodiment of the slider device of FIG. 1.

Still referring to FIG. 1, the slider device 150 is provided to open and close the resealable closure mechanism 114. As discussed above, the slider device 150 is constructed and arranged to engage or interface with the resealable closure mechanism to selectively open or close the flexible package 110. Referring now to FIGS. 3 and 4, a slider device 150 is described that is operable with the resealable closure mechanism described in connection with FIG. 2. The slider device 150 is illustrated in FIGS. 3 and 4 in perspective view and preferably comprises a one-piece unitary, molded plastic member with no moveable parts that are moveable with respect to one another. In general, the slider device 150 includes a housing 152 for slidably engaging the closure mechanism 114. The housing 152 is movable between a closed position of the resealable package 110 when the housing 152 is adjacent the side edge 120 and an open position of the resealable package 110 when the housing 152 is adjacent the side edge 122. FIG. 1 illustrates the resealable package 110 in an open position. The housing 152 slides over the resealable closure mechanism 114 relative to the top edge 127 of the resealable package 110 to open and close the mouth 126.

The housing 152 is preferably a multi-sided container configured for locking onto or over the resealable closure mechanism 114. In the particular embodiment illustrated in FIGS. 3 and 4, the housing 152 includes a top wall 154. By the term "top", it is meant that in the orientation of the slider device 150 shown in FIG. 1, the wall 154 is oriented above remaining portions, such as the sidewalls 158, 159 and the first and second protrusions 167, 168 described below. It should be understood, of course, that if the housing 152 is moved from the orientation shown in FIG. 1, the top wall 154 will not be in a top orientation. The top wall 154 defines a first end 155 and an opposite second end 156.

In reference again to FIGS. 3 and 4, the preferred housing 152 shown also includes first and second sidewalls 158, 159. Preferably, each of the first and second sidewalls 158, 159 extends from and is cantilevered from the top wall 154 to form a slide channel 151 therebetween. In preferred embodiments, the first and second sidewalls 158, 159 are injection molded with the remaining parts of the housing 152. In other words, preferably the housing 152 comprises a single, unitary, integral piece of material with no additional materials welded, fastened, or bolted together. As can be viewed in FIGS. 3 and 4, the sidewalls 158, 159 can include texturization, such as ribs, 163, 164 to help improve gripping and handling by the user.

The housing 152 includes an engagement structure 162 for interlocking and/or separating the interlocking or mating profiled elements of the resealable closure mechanism 114. That is, when the resealable closure mechanism 114 is in an open state, the engagement structure 162 will apply a force to interlock the closure members 170, 188. Conversely, when the resealable closure mechanism 114 is in a closed state such that the closure members 134, 144 are interlocked, the engagement structure 162 will apply a force to open and pull the closure members 172, 190 apart from each other.

Figure 4A:
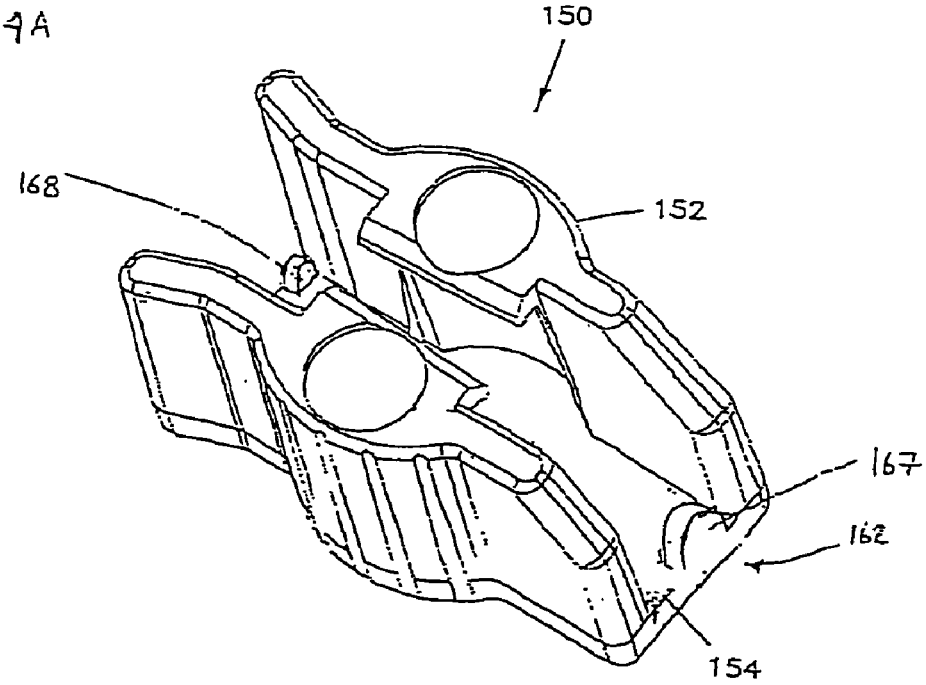
FIG. 4A is an enlarged, bottom perspective view of one possible embodiment of the slider device of FIGS. 1 and 3.
Figure 5:
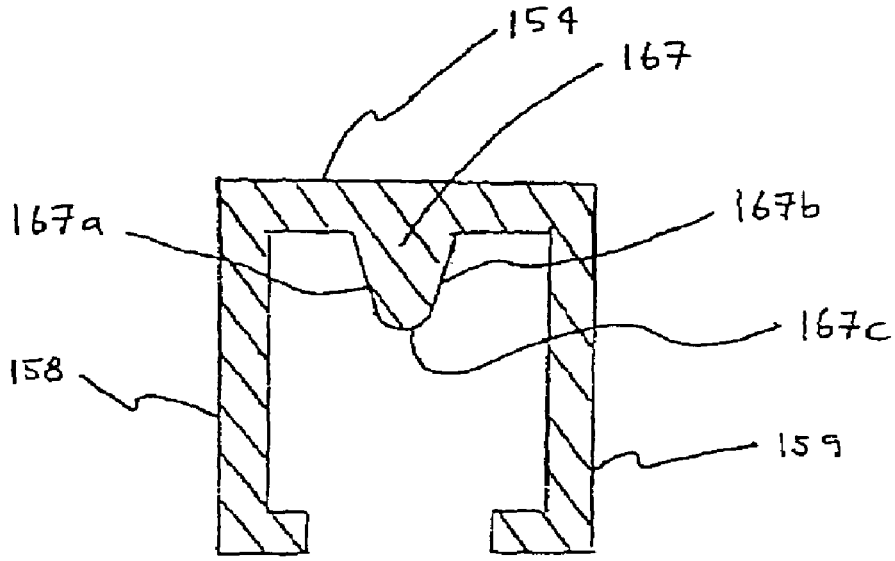
FIG. 5 is a cross-sectional view of the slider device of FIG. 1 taken along the line A—A of FIG. 1.

While many embodiments of the engagement structure 162 for interlocking and/or separating the resealable closure mechanism 114 are contemplated, one particular embodiment will be described in connection with FIGS. 3 and 4A. In the embodiment illustrated in FIG. 4A, the engagement structure 162 includes a first projection, protuberance, or protrusion 167 and a second projection, protuberance, or protrusion 168 for interlocking and/or separating the first and second closure profiles 170, 188. Preferably, the first protrusion 167 is provided and is integral with the first end 155 of the top wall 154 of the slider device 150. In the preferred embodiment shown, the first protrusion 167 depends from the top wall 154 and is constructed and arranged to engage the locking finger 180 of the first closure member 170. As shown in FIG. 5, the first protrusion 167 includes a pair of inclined sidewalls 167*a*, 167*b* joined at a smooth, rounded end 167*c*. The first protrusion 167 depends from the top wall 154 substantially near the center of the top wall 154 or centered between the sidewalls 158, 159. By "substantially near," it is meant that the first protrusion 167 is located between about 45–55% of the distance between the sidewalls 158, 159.

Figure 6:
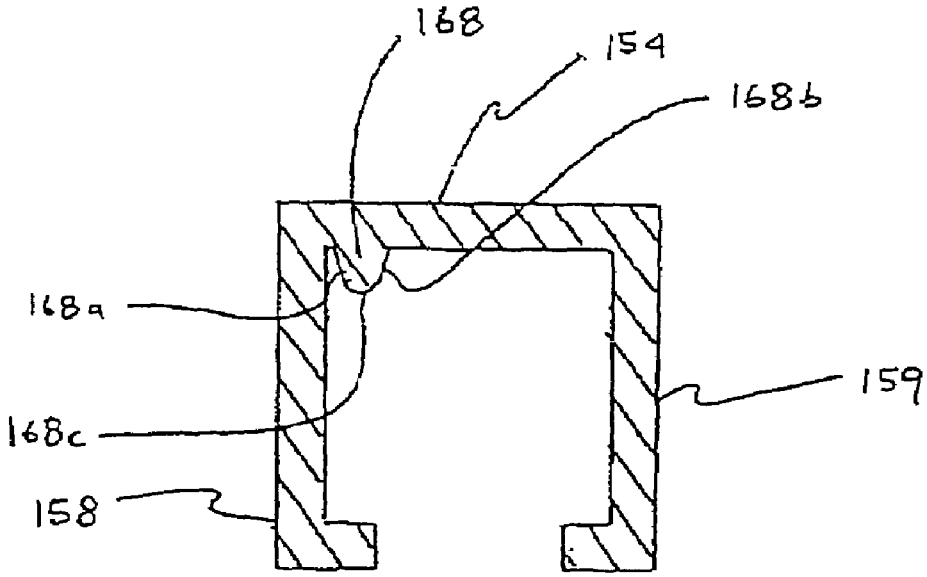
FIG. 6 is a cross-sectional view of the slider device of FIG. 1 taken along the line B—B of FIG. 1.

Preferably, the second protrusion 168 is provided and is integral with the second end 156 of the top wall 154 of the slider device 150. In the preferred embodiment shown, the second protrusion 168 depends from the top wall 154 and is constructed and arranged to engage the locking finger 180 substantially near the neck portion 181. As shown in FIG. 6, the second protrusion 168 includes a pair of inclined sidewalls 168*a*, 168*b* joined at a smooth, rounded end 168*c*. The second protrusion 168 depends from the top wall 154 substantially near a sidewall of the slider device 150 corresponding to the locking finger 180 of the resealable closure mechanism 114. For example, the second protrusion 168 depends from the top wall 154 substantially near the sidewall 158 as shown in FIG. 6. By "substantially near," it is meant that the distance separating the sidewall 158 and the second protrusion 168 is no more than about the width of the second protrusion 168 and preferably no more than about 50% of the width of the second protrusion. In some embodiments, this is about 0.1–5 mm.

Figure 4B:
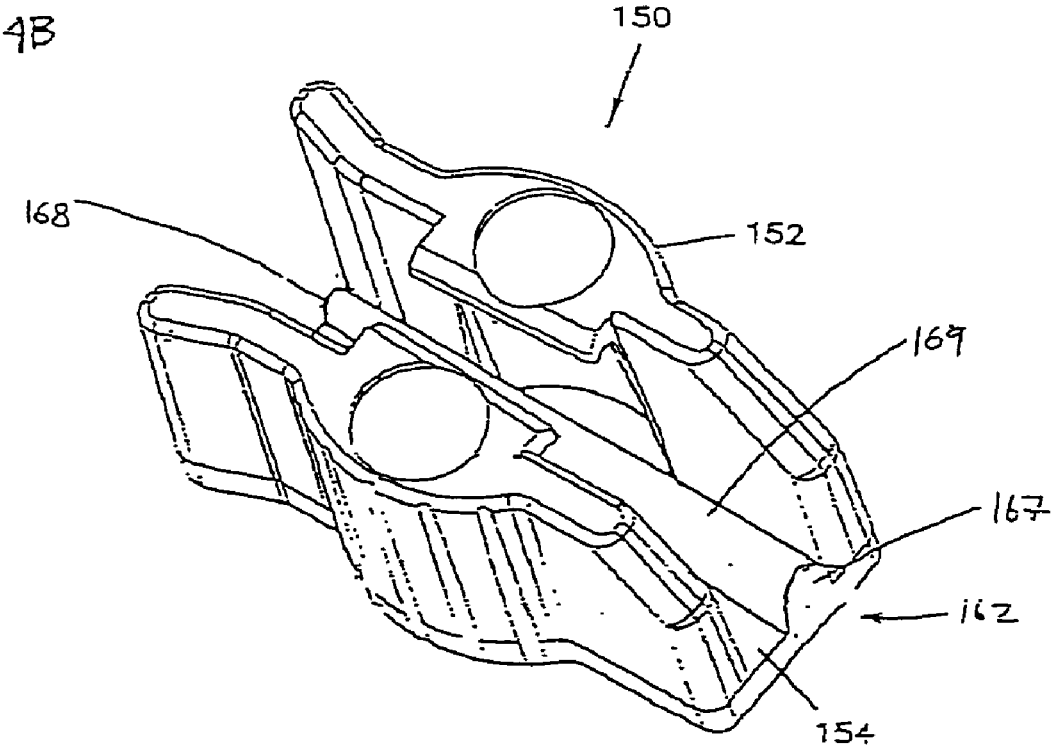
FIG. 4B is an enlarged, bottom perspective view of an alternative embodiment of the slider device of FIGS. 1 and 3.

It should be understood that the engagement structure 162 can have any configuration suitable for interlocking and/or separating the resealable closure mechanism 114. For example, as illustrated in FIG. 4B, the engagement structure 162 can include a single protrusion 169 extending from the first end 155 to the second end 156 of the slider device 150. In this embodiment, the protrusion 169 has a varying profile. By "varying profile," it is meant that the engagement structure 162 has a non-constant cross-section that varies from the first end 155 towards the second end 156 of the slider device 150. For example, the protrusion 169 in constructed and arranged to engage the locking finger 180 at or near the first end 155. Similarly, the protrusion 169 in constructed and arranged to engage the locking finger 180 substantially near the neck portion 181 at or near the second end 156. In so doing, the slider device 150 engages the closure profiles 170, 188 and progressively moves them out of engagement to open the resealable package 110 when the slider device is moved along the closure mechanism 114 in a first direction. Similarly, the slider device 150 engages the closure profiles 170, 188 and progressively moves them into engagement to close the resealable package 110 when the slider device is moved along the closure mechanism 114 in a direction opposite the first direction.

In a preferred embodiment, the slider housing 152 has an overall length from the first end 155 to the second end 156 of at least about 0.5 inches (about 13 mm), no greater than about 2 inches (about 51 mm), typically about 0.65–0.75 inches (about 16–19 mm), and in a preferred embodiment about 0.695 inches (about 18 mm). The length of the first protrusion 167 extending between the first end 155 and the second end 156 is no more than 25% of the length of the slider housing 152, and is preferably less than 10% of the length of the slider housing 152 as shown in FIG. 4. Similarly, the length of the second protrusion 168 extending between the first end 155 and the second end 156 is no more than 25% of the length of the slider housing 152, and is preferably less than 10% of the length of the slider housing 152 as shown in FIG. 4.

Figure 7:
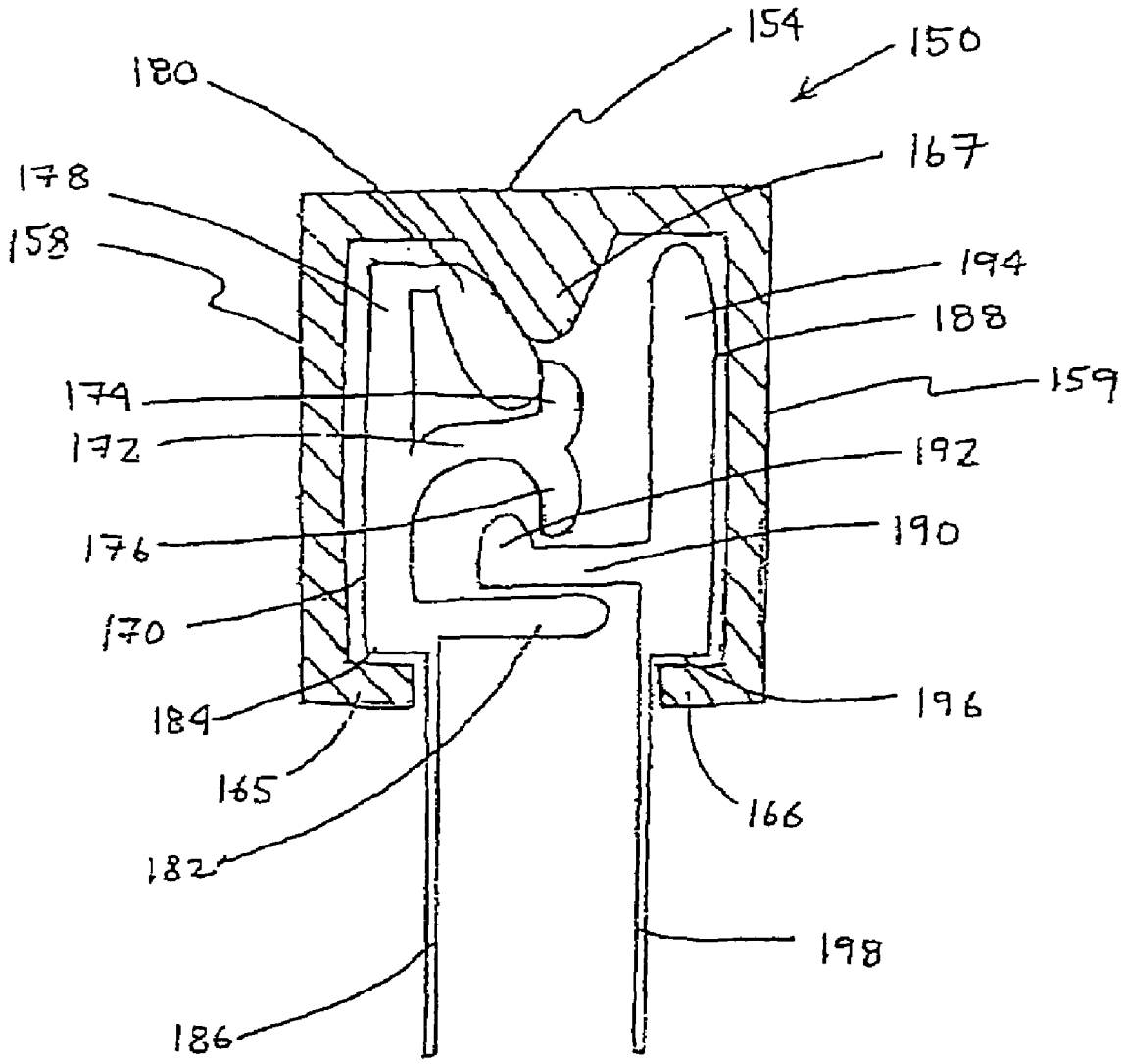
FIG. 7 is a cross-sectional view of the slider device of FIG. 1 taken along the line A—A of FIG. 1 and being operably mounted on the profiled elements depicted in FIG. 2.
Figure 8:
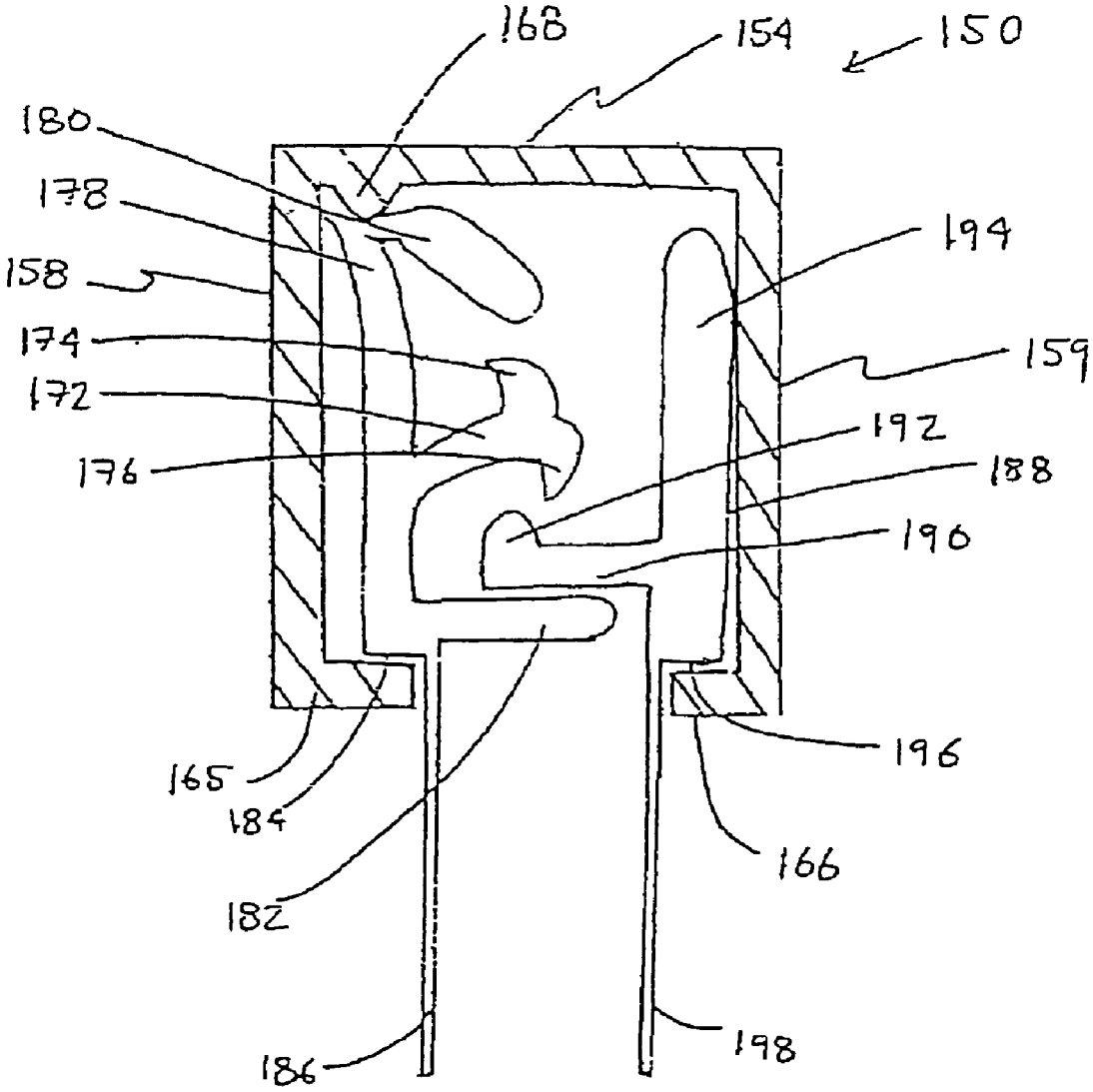
FIG. 8 is a cross-sectional view of the slider device of FIG. 1 taken along the line B—B of FIG. 1 and being operably mounted on the profiled elements depicted in FIG. 2.

Now referring to FIGS. 7 and 8, a cross-sectional view of the slider device 150 of FIG. 1 is shown at the first and second ends 155, 156, respectively, operably mounted to the resealable closure mechanism 114. As shown in FIG. 7, the first protrusion 167 depends from the top wall 154 at or near the first end 155 (FIG. 3) of the slider device 150. The first protrusion 167 is constructed and arranged to engage the locking finger 180 substantially at or near the free or distal end 180*a* of the locking finger 180. By "engage," it is meant that the first protrusion 167 slidably communicates with and pushes downward on the locking finger 180 such that the distal end portion 180*a* deflects downward into engagement with catch 174 of the first closure member 172. Specifically, the first protrusion 167 forces the locking finger 180 into engagement with the upper latching portion 174 of the first closure member 172. Additionally, the first closure member 172 is also deflected downward into engagement with the second closure member 190. As a result, the closure member 172 of the first closure profile 170 interlocks with the closure member 190 of the second closure profile 188.

Referring now to FIG. 8, the second protrusion 168 depends from the top wall 154 at or near the second end 156 (FIG. 3) of the slider device 150. The second protrusion 168 is constructed and arranged to engage the locking finger 180 substantially at or near the neck portion 181 of the locking finger 180 or the upper flange 178. By "engage," it is meant that the second protrusion 168 slidably communicates with and pushes downward on the neck portion 181 (e.g., at taper 181*a*) of the locking finger 180 such that the distal end portion 180*a* deflects out of engagement with catch 174 of the first closure member 172. Specifically, the second protrusion 168 forces the locking finger 180 to disengage from the upper latching portion 174 of the first closure member 172. As a result, the lower latching portion 176 of the first closure member 172 disengages from the second closure member, which allows the first and second closure profiles 170, 188 to be separated.

Preferably, the housing 152 includes a system for permitting the housing 152 to slide along the resealable closure mechanism 114 without becoming disengaged from the resealable package 110. In the embodiment illustrated, the system of the slider housing 152 engages or interlocks with certain structure of the resealable closure mechanism 114. In particular, the housing 152 has a first and a second hook construction 165, 166. The first hook construction 165, preferably extends from the first sidewall 163 and the second hook construction 166 extends from the second sidewall 164.

To construct the flexible resealable package 110 with a slider device 150, the package 110 can be formed by either a blown extrusion process or by using a pre-formed roll of film. The film is folded in the form shown in FIG. 1. The resealable closure mechanism 114 can be applied to the film panel sections 116, 117 by heat-sealing the bonding strips 132, 142 to the film sections. The notch 128 can be cut into the upper flanges 178, 194. Next, the side seals including the regions 119, 121 of ultrasonic crushing can be formed. The housing 152 can then be mounted over the resealable closure mechanism 114 by sliding it onto the notch 128.

The housing 152 is pressed onto the resealable closure mechanism 114 until the first and second hook constructions 165, 166 snap over the shoulders 184, 196, respectively, of the closure profiles 170, 188, respectively.

In operation, the slider device 150 is slid relative to the resealable closure mechanism 114 from the closed position adjacent to the side edge 120 to the open position adjacent to the side edge 122. As the slider device 150 is moved from the open position to the closed position, the first protrusion 167 engages slidably communicates with and pushes downwardly on the locking finger 180 of the first closure profile 170. Consequently, the distal end portion 180*a* deflects downward and is biased into engagement with catch 174 of the first closure member 172. Specifically, the first protrusion 167 forces the locking finger 180 into engagement with the upper latching portion 174 of the first closure member 172. The first closure member 172 is correspondingly deflected downward into engagement with the second closure member 190. As a result, the first closure profile 170 interlocks with the second closure profile 188.

As the housing 152 is moved from the closed position to the open position, the second protrusion 168 slidably communicates with and pushes downward on the neck portion 181 of the locking finger 180 such that the distal end portion 180*a* deflects out of engagement with the catch 174 of the first closure member 172. In the embodiment shown in FIG. 8, the second protrusion 168 engages the taper 181*a* of the locking finger 180 to deflect the locking finger 180 out of engagement with the upper latching portion 174 by forcing the upper flange 178 away from the second closure profile 188. As a result, the lower latching portion 176 of the first closure member 172 disengages from the second closure member 190 which allows the first and second closure profiles 170, 188 to be separated.

Figure 9:
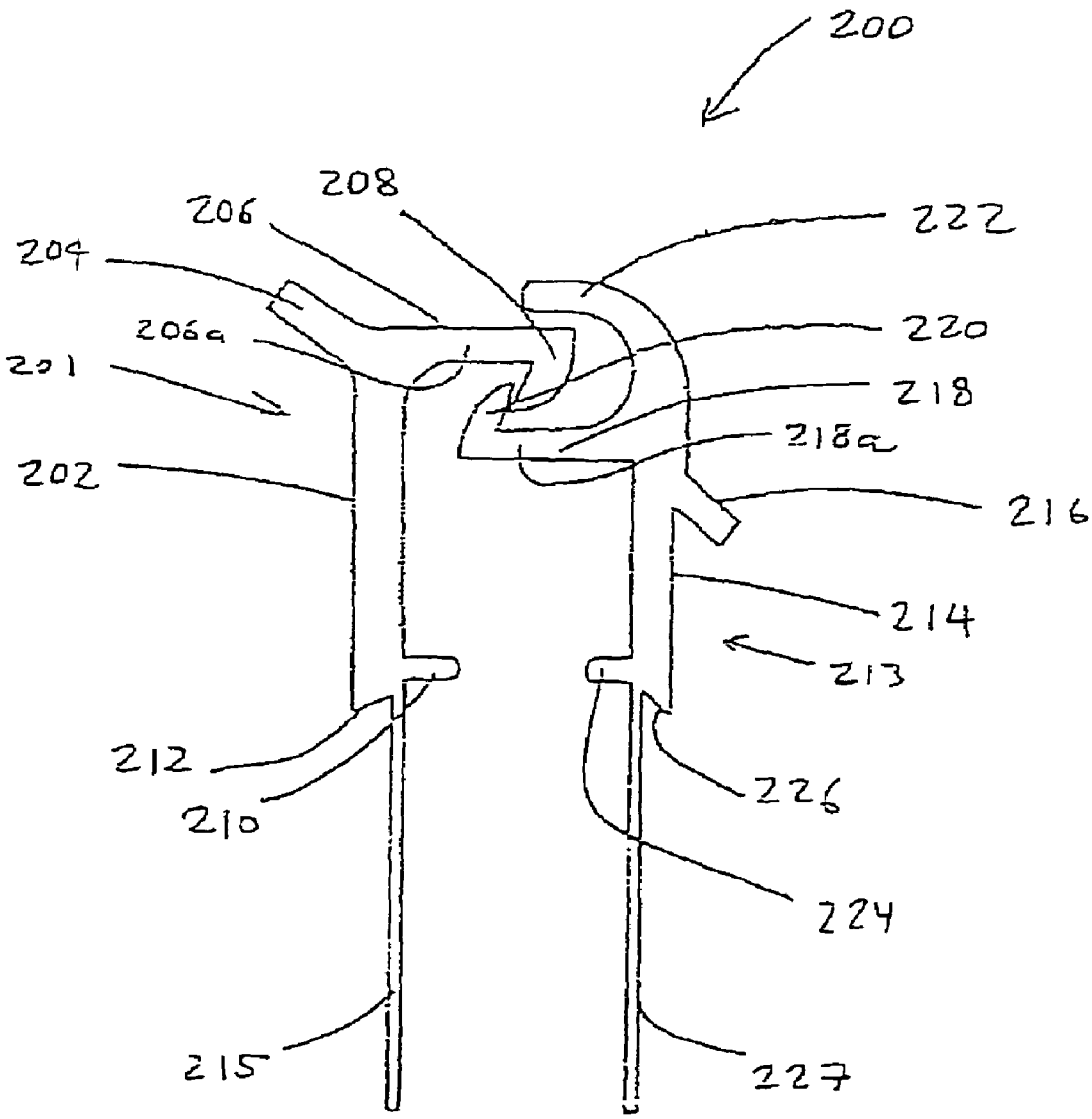
FIG. 9 is a cross-sectional view of a second embodiment of profiled elements usable with the resealable package of FIG. 1, according to principles of this disclosure.

FIGS. 9 through 15 illustrate an alternative embodiment of a slider device having contoured top and sidewalls for engaging or interfacing with a resealable closure mechanism. In particular, the zipper-type closure mechanism shown in FIG. 9 is an illustration of an alternative embodiment of a resealable closure mechanism 114 (FIG. 1) for use with a slider device having contoured top and sidewalls. The closure mechanism 200 in FIG. 9 includes an elongated first closure profile 201 and an elongated second closure profile 213. As discussed above with respect to the closure mechanism 114, typically, the closure profiles 201, 213 are manufactured separately from each other.

Still in reference to FIG. 9, the first closure profile 201 includes a sealing flange or bonding strip 215, a base strip 202, a first closure member 206, a first guidepost 210, and a flange or lever member 204. The closure member 206 extends from the base strip 202 by way of a stem 206*a* and is generally projecting from the base strip 202. At a free end of the stem 206*a* (the tip of the closure member 206) is a hook or catch 208. The flange or lever member 204 extends from the base strip 202 opposite the closure member 206. The guidepost 210 extends from and is generally projecting from the base strip 202. The guidepost 210 adds rigidity to the lower portion of the first closure profile 201. The bonding strip 215 depends or extends downward from the guidepost 210 and can be attached to a first panel section, such as the first panel section 116 of the package 110 of FIG. 1 at region 135 (FIG. 1). A first shoulder 212 is defined by the intersection of the base strip 202 and bonding strip 215. In the example illustrated, the bonding strip 215 is spaced a distance laterally from the base strip 202 to define a corner forming the shoulder 212.

The preferred second closure profile 213 includes a bonding strip 227, a base strip 214, a first guidepost 224, a second guidepost 222, and a second closure member 218. The closure member 218 extends from the base strip 214 by way of a stem 218*a* and is generally projecting from the base strip 214. At a free end of the stem 218*a* (or tip of the closure member 218) is a hook or catch 220. A flange or lever member 216 extends from the base strip 214 opposite the second closure member 218. The first guidepost 224 extends from the base strip 214 and is generally projecting from the base strip 214. The first guidepost 224 adds rigidity to the lower portion of the second closure profile 213. The second guidepost 222 also extends from and is generally projecting from the base strip 214. The second guide post 222 aids in holding the closure mechanism 200 closed and in aligning the first closure profile 201 with the second closure profile 213 for interlocking. The bonding strip 227 depends or extends downward from the base strip 214 and can be attached to a second panel section, such as the second panel section 118 of the package 110 of FIG. 1. A shoulder 226, analogous to the shoulder 212, is formed at the corner of the bonding strip 227 and the base strip 214.

The first and second closure profiles 210, 213 are designed to engage with one another to form the resealable closure mechanism 200. The closure member 218 of the first closure profile 213 extends from the base strip 214 a first distance. The closure member 218 of the second closure profile 213 also extends from the base strip 214 a first distance. These first distances that the closure members 201, 213 extend are sufficient to allow mechanical engagement, or interlocking, between the first closure member 206 of the first closure profile 201 and the second closure member 218 of the second closure profile 213. Therefore, the catches 208, 220 are allowed to hook or engage each other. Furthermore, as discussed above in connection with resealable closure mechanism 114, the closure profiles 201, 213 are sealed together at their ends, such as regions 119, 121 of FIG. 1, to further aid in aligning the closure profiles 201, 213 for interlocking through processes such as ultrasonic crushing.

The first flange member 204 is cantilevered from the first closure profile 201 at an angle of about between 20 and 70 degrees, typically between 40 and 50 degrees, and preferably 45 degrees with respect to the base strip 202. Similarly, the second flange member 216 is cantilevered from the second closure profile 213 at an angle of about between 20 and 70 degrees, typically between 40 and 50 degrees, and preferably 45 degrees with respect to the base strip 214.

The openable sealed closure mechanism 200 is formed by pushing the closure profiles 201, 213 towards one another into engagement. For example, the first and second closure profiles 201, 213 can be pushed towards one another such that the distance between the first and second closure profiles 201, 213 is reduced. Similarly, the distance between the first and second bonding strips 215, 227 is also reduced. In so doing, the first closure member 201 interlocks with the second closure member 213. As discussed above, the second guide post 222 aids in aligning the first and second closure profiles 210, 213 with one another, thereby, facilitating interlocking between the two.

To disengage the first and second closure profiles 201, 213 from one another, each of the flange members 204, 216 can be acted on to disengage the first closure profile 201 from the second closure profile 213. For example, in the embodiment shown in FIG. 9, the first flange member 204 of the first closure profile 201 can be pushed downward. In so doing, the first closure member 206 is forced upwards and out of engagement with the second closure member 218. Similarly, the second flange member 216 can be directed upwards, thereby forcing the second closure member 218 downward and out of engagement with the first closure member 218. Once the first and second closure members 206, 218 are disengaged, the first and second closure profiles 201, 213 can be pulled apart to provide access to the contents of the package 110 through the mouth 126 (FIG. 1).

As with the resealable closure mechanism 114 discussed above, the closure profiles 201, 213 are formed by two separate extrusions or through two separate openings of a common extrusion. Typically, the resealable closure mechanism 200 is made of conventional materials, such as a polymeric, plastic material, for example, polyethylene or polypropylene. In one example embodiment, the closure arrangement illustrated in FIG. 9 is manufactured using conventional extrusion and heat-sealing techniques.

Figure 10:
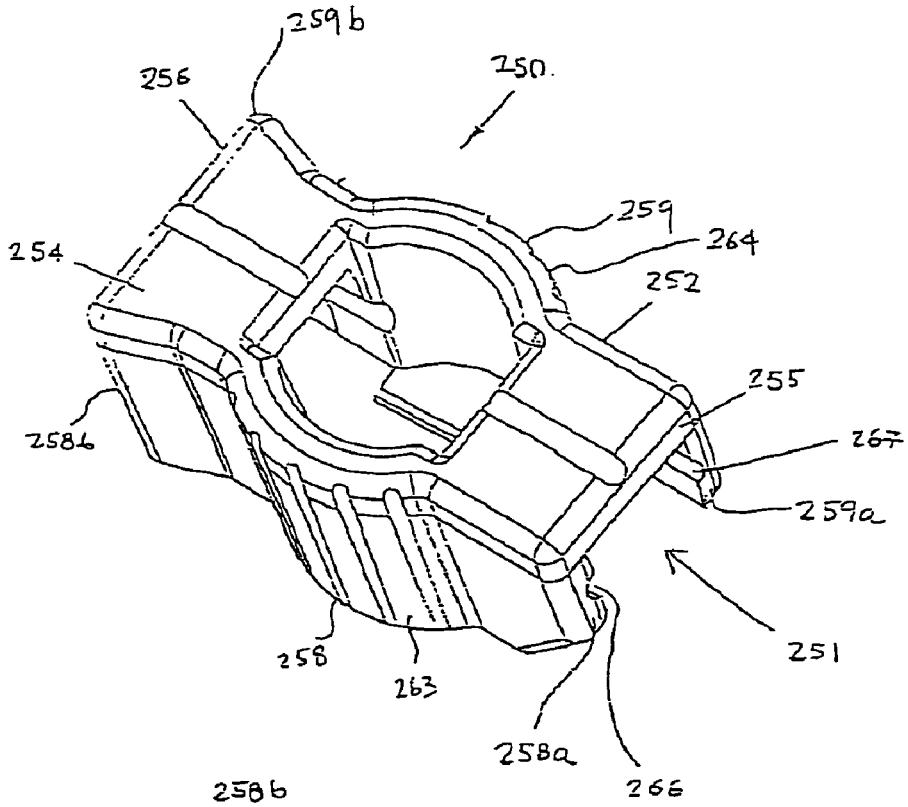
FIG. 10 is an enlarged, top perspective view of a second embodiment of the slider device of FIG. 1.
Figure 11:
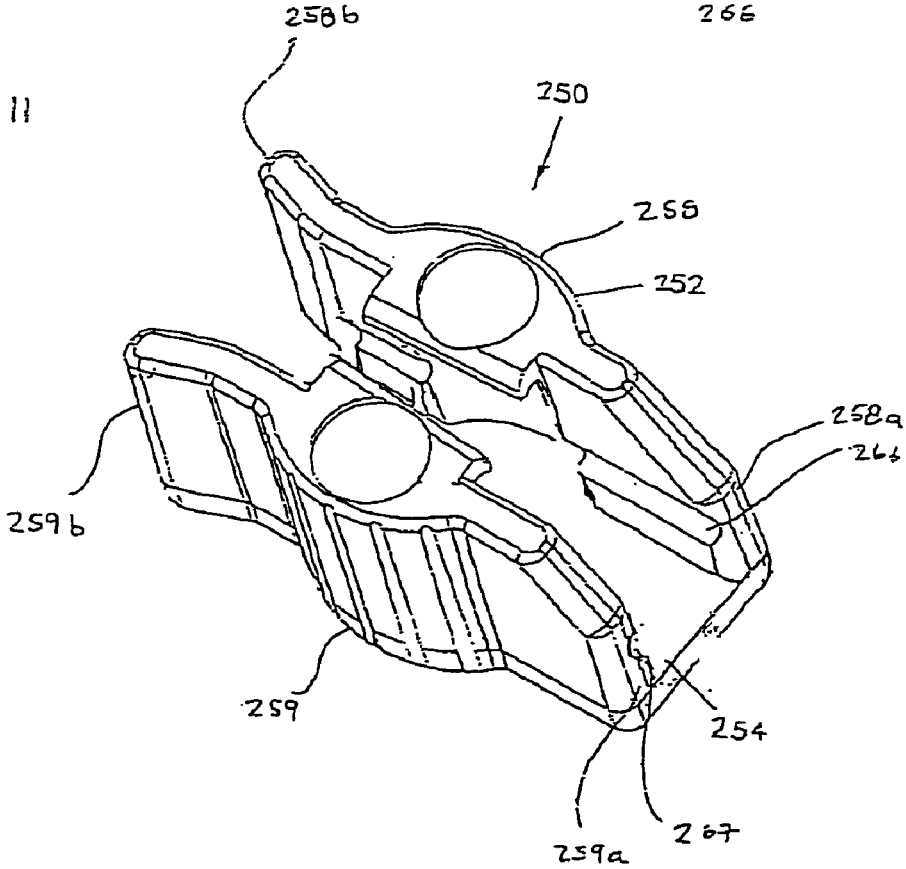
FIG. 11 is an enlarged, bottom perspective view of the slider device of FIG. 10.

FIGS. 10 and 11 illustrate a slider device having contoured sidewalls that engage or interlock with the first and second closure profiles 201, 213 to selectively open and close the resealable closure mechanism 200. A preferred slider device 250 is illustrated in FIGS. 10 and 11 in perspective view and preferably comprises a one-piece unitary, molded plastic member with no moveable parts that are moveable with respect to one another. In general, the slider device 250 includes a housing 252 for slidably engaging the closure mechanism 220. The housing 252 is movable between a closed position of the resealable package 110 (such as the resealable package shown in FIG. 1) when the housing 252 is adjacent the side edge 120 and an open position of the resealable package 110 when the housing 252 is adjacent the side edge 122. For example, FIG. 1 illustrates the resealable package 110 in an open position. The housing 252 slides over the resealable closure mechanism 200 relative to the top edge 127 of the resealable package 110 to open and close the mouth 126.

The housing 252 is preferably a multi-sided container configured for engaging or locking onto or over the resealable closure mechanism 114. In the particular embodiment illustrated in FIGS. 10 and 11, the housing 252 includes a top wall 254. By the term "top", it is meant that in the orientation of the slider device 250 shown in FIG. 1, the wall 254 is oriented above the remaining portions of the housing 252, such as the sidewalls 258, 259. It should be understood, of course, that if the housing 252 is moved from the orientation shown in FIG. 1, the top wall 254 will not be in a top orientation. The top wall 254 defines a first or front end 255 and an opposite second or rear end 256.

In reference again to FIGS. 10 and 11, the preferred housing 252 shown also includes first and second sidewalls 258, 259. Preferably, each of the first and second sidewalls 258, 259 extends from and is cantilevered from the top wall 254 to form a slide channel 251 therebetween. In the preferred embodiment, the first and second sidewalls 258, 259 are injection molded with the remaining parts of the housing 252. In other words, preferably the housing 252 comprises a single, unitary, integral piece of material with no additional materials welded, fastened, or bolted together. As with the slider device 150 described above, the sidewalls 258, 259 of the slider device 250 can include texturization, such as ribs, 263, 264 to help improve gripping and handling by the user.

In the embodiment shown in FIGS. 10 and 11, each of the first and second sidewalls 258, 259 define a slide channel 266, 267 for receiving and engaging the flange or lever members 204, 216 of the resealable closure mechanism 200. Each of the slide channels 266, 267 define a guide construction for receiving and engaging respective flange members 204, 216 of the resealable closure mechanism 200. The slide channel 266 defined in the first sidewall 258 extends from the first end 258*a* to the second end 258*b*. Similarly, the slide channel 267 defined in the second sidewall 259 extends from the first end 259*a* to the second end 259*b*.

Figure 12:
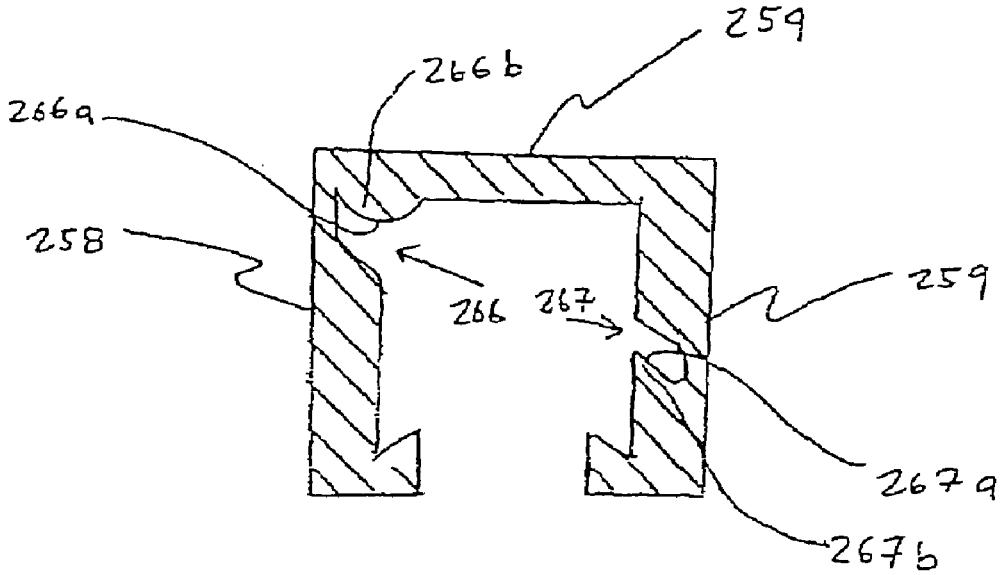
FIG. 12 is a cross-sectional view of the slider device of FIGS. 10 and 11 taken along the line A—A of FIG. 1.

FIG. 12 is a cross-sectional view of the slider device 250 taken at its first end 255. At their respective first ends 258*a*, 259*a*, the slide channels 266, 267 includes first and second contoured inner surfaces 266*a*, 267*a* projecting or extending into respective slide channels 266, 267. The first slide channel 266 at or substantially near the first end 258*a* includes an angling or jutting portion 266*b* that extends from the top wall 259 and is sized and configured to accommodate the flange or lever members 204 of the first closure profile 201. Similarly, the second slide channel 267 at or substantially near the first end 259*a* includes an angling or jutting portion 267*b* sized and configured to accommodate the flange or lever member 216 of the second closure profile 213. By "substantially near," it is meant that the configuration of the angling or jutting porting 266*b*, 267*b* extends no further than about 50% of the length of the first slide channel 266 from the first ends 258*a*, 259*a*, preferably about 25% of the length of the first slide channel 266 from the first ends 258*a*, 259*a*. Moreover, by "accommodate," it is meant that the configuration of the slide channels 266, 267 do not engage, deflect, or exert any forces on the flange or lever members 204, 216. Accordingly, when the resealable closure mechanism 200 is positioned at or near the first end 258*a*, 259*a* of the slide channels 266, 267, the first and second closure profiles 210, 213 are allowed to remain in a natural, unbiased configuration as shown in FIG. 9.

Figure 13:
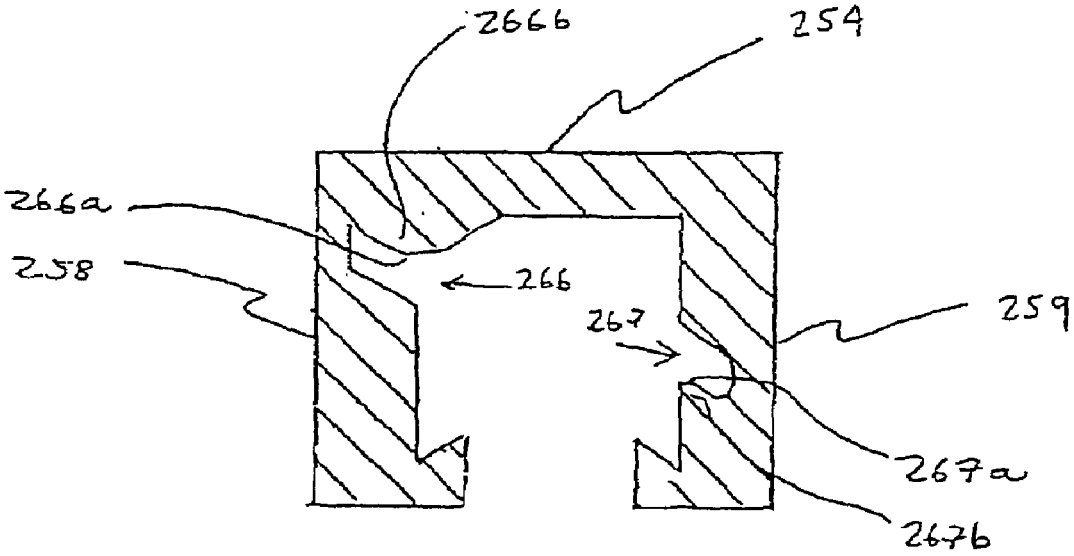
FIG. 13 is a cross-sectional view of the slider device of FIGS. 10 and 11 taken along the line B—B of FIG. 1.

FIG. 13 is a cross-sectional view of the slider device 250 taken at its second end 256. The first contoured inner surface 266*a* at or substantially near its second end 258*b* is configured to engage the flange or lever member 204 of the first closure profile 201. Specifically, the angling or jutting portion 266*b* is sized and configured to engage the flange or lever member 204 of the first closure profile 201. Similarly, the second contoured inner surface 267*a* (FIG. 13) at or near its second end 259*b* is configured to engage the flange or lever member 216 of the second closure profile 213. Specifically, the angling or jutting portion 267*b* is sized and configured to engage the flange or lever member 216. By "engage," it is meant that the first and second contoured inner surfaces 266*a*, 267*a* deflect the flange or lever members 204, 216 such that the closure members 206, 218 disengage. Accordingly, when the resealable closure mechanism 200 is positioned at or near the second end 258*b*, 259*b* of the slide channels 266, 267, the first and second closure profiles 210, 213 disengage from one another.

Figure 14:
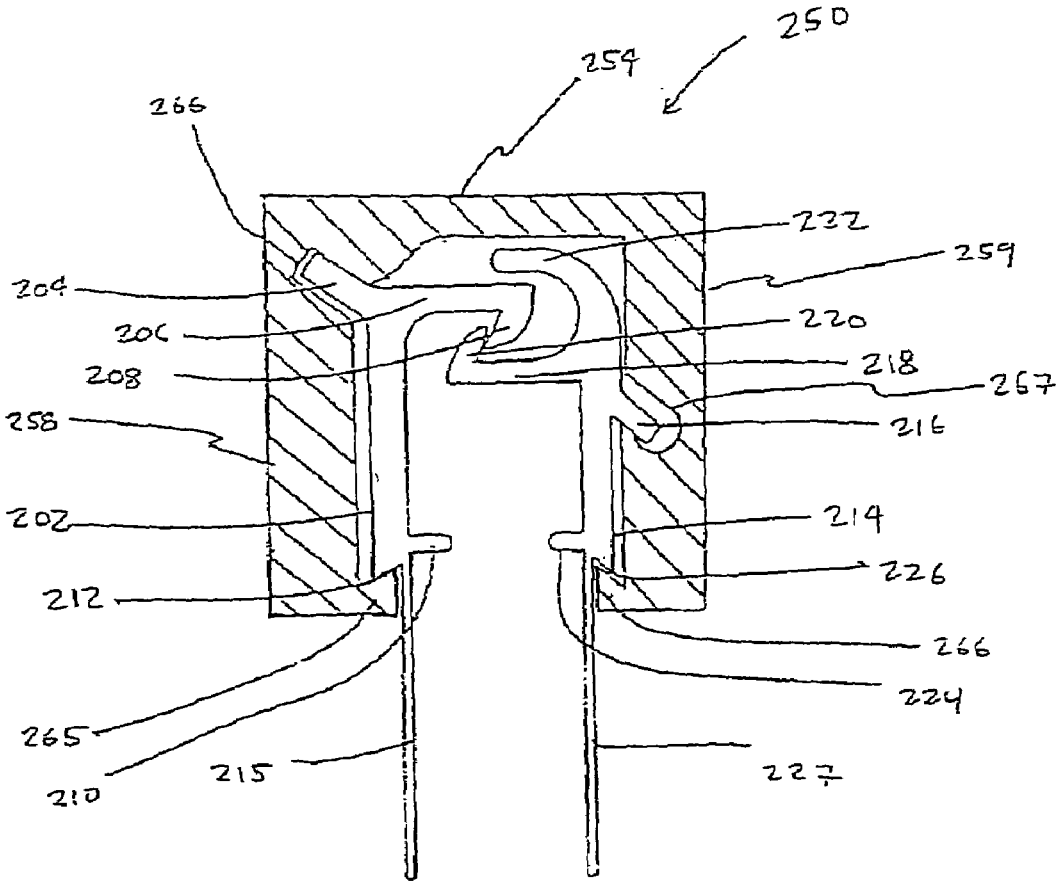
FIG. 14 is a cross-sectional view of the slider device of FIGS. 10 and 11 taken along the line A—A of FIG. 1 being operably mounted on the profiled elements depicted in FIG. 9.
Figure 15:
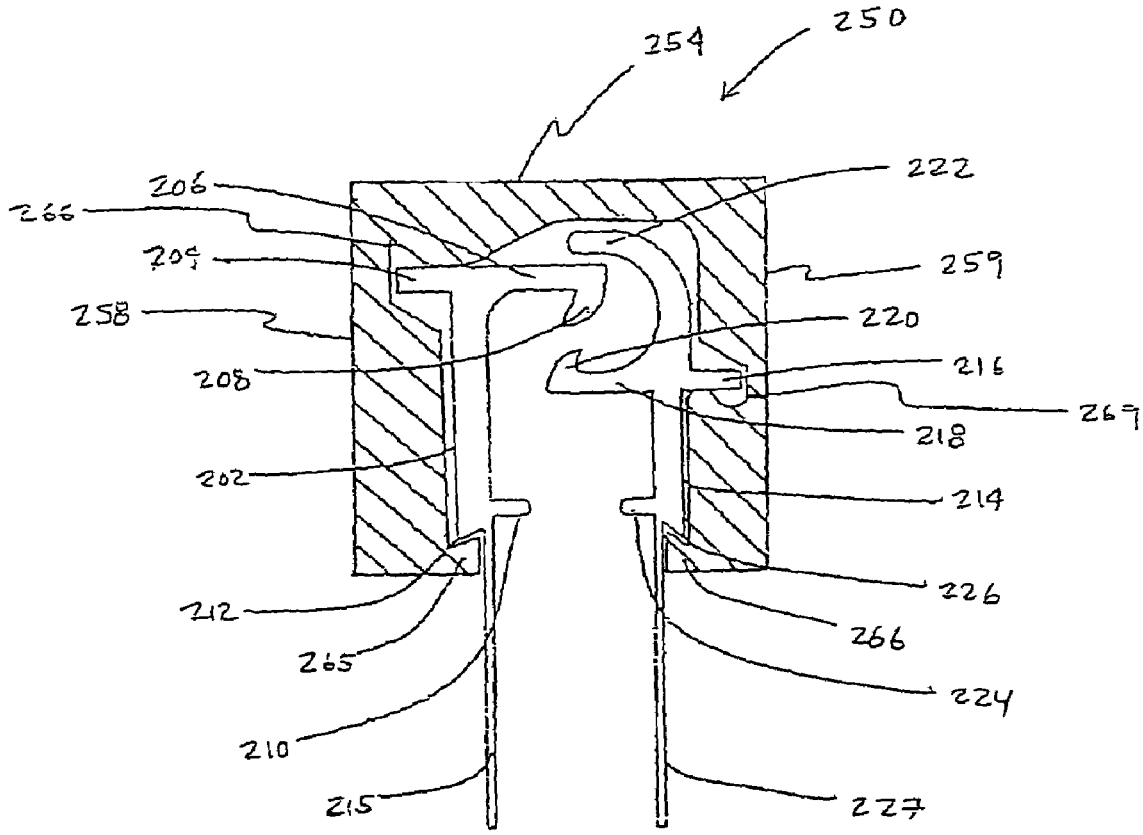
FIG. 15 is a cross-sectional view of the slider device of FIGS. 10 and 11 taken along the line B—B of FIG. 1 being operably mounted on the profiled elements depicted in FIG. 9.

Referring now to FIGS. 14 and 15, a cross-sectional view of the slider device 250 is shown at the first and second ends 255, 256 of the slider device 250, respectively, operably mounted on the resealable closure mechanism 200. FIG. 14 depicts a cross-section of the slider device 250 near the first end 255 of the slider device 250. The first slide channel 266 defined in the first sidewall 258 receives and engages the flange member 204 cantilevered from the first closure profile member 201. At the first end 255 of the slider device 250, the first slide channel 266 has a configuration that accommodates the flange member 204. By "accommodate," it is meant that the configuration of the first slide channel 266 does not engage, deflect, or exert any forces on the flange member 204 of the first closure profile 201. Similarly, at the first end 255 of the slider device 250, the second slide channel 267 has a configuration that accommodates the flange member 216. Thus, the first and second closure profiles 210, 213 are allowed to remain in a natural, unbiased configuration as shown in FIG. 7. Accordingly, when the first and second closure profiles 201, 213 are brought into engagement as shown in FIG. 14, the closure members 206, 218 are biased into an interlock position.

FIG. 15 depicts a cross-section of the slider device 250 near the second end 256 of the slider device 250. The configuration of the slide channel 266, 267 engages the flange members 204, 216 of the first and second closure profiles 210, 213. For example, as described above, the slide channels 266, 267 include contoured inner surfaces 266*a*, 267*a* that are sized and configured to engage the flange members 204, 216. By "engage," it is meant that the configuration of the slide channels 266, 269 deflect the flange members 204, 216 such that the closure members 206, 218 disengage. Specifically, the angling or jutting portion 266*b* pushes downwards on the flange member 204. In so doing, the first closure member 206 is correspondingly deflected upwards. Similarly, the angling or jutting portion 267*b* pushes upwards on the flange member 216. In so doing, the second closure member 218 is correspondingly deflected downwards. As a result, the first and second closure members 206, 218 disengage and may be pulled apart from one another to open the resealable package.

In one embodiment, the sidewalls 258, 259 are tapered. By "tapered," it is meant that the distance separating the slide channels 258, 259 decreases from the front end 255 of the slider device 250 to the second end 256 of the slider device 250. Accordingly, when the slider device 250 is moved along the resealable closure mechanism 200, the sidewalls at the second end 256 of the slider device 250 push the first and second closure profiles 201, 213 into engagement allowing the first and second closure members 206, 218 to interlock. Conversely, the sidewalls 258, 259 at the first end 255 of the slider device 250 tend to pull the first and second closure profiles 201, 213 apart.

Preferably, the housing 252 includes a system for permitting the housing 252 to slide along the resealable closure mechanism 200 without becoming disengaged from the resealable package. In the embodiment illustrated, the system of the slider housing 252 engages or interlocks with certain structure of the resealable closure mechanism 200. In particular, the housing 252 has a first and a second hook construction 265, 266. The first hook construction 265, preferably extends from the first sidewall 258 and the second hook construction 266 extends from the second sidewall 259. Accordingly, the first and second hook construction 265, 266 aid in separating the first and second closure profiles 201, 213 when the slider device 250 is moved along the resealable closure mechanism 200 in a second direction.

In operation, the slider device 250 is slid relative to the resealable closure mechanism 200 from the opened position adjacent to the side edge 122 to the closed position adjacent to the side edge 120. As the slider device 250 is moved from the opened position to the closed position, the slide channels 266, 267 slidably communicate with and receive the flange members 204, 216. For example, the slide channel 266 slidably communicates with and receives the flange member 204 allowing it remain in its natural, unbiased configuration as described above. Similarly, the slide channel 267 slidably communicates with and receives the flange member 216 allowing it to remain in its natural, unbiased configuration as described above. Furthermore, as discussed above, the sidewalls 258, 259 are tapered. Thus, as the slider device 250 is moved from the opened position to the closed position, the sidewalls 258, 259 at the first end 255 of the slider device 250 push or urge the first and second closure profiles 201, 213 into engagement. As a result, the first and second closure members 206, 218 are allowed to interlock.

Conversely, the slider device 250 may be slid relative to the resealable closure mechanism 200 from the closed position to the opened position. As the slider device 250 is moved from the closed position to the opened position, the slide channels 266, 267 slidably communicate with and engage the flange members 204, 216. For example, the slide channel 266 slidably communicates with and pushes downward on the first flange member 204, thereby causing the first closure member 206 to move upwards and away from the second closure member 218. Similarly, the slide channel 267 slidably communicates with and engages the second flange member 216, thereby causing the second closure member to move downwards and away from the first closure member 206. Accordingly, the first and second closure profiles 201, 213 disengage and allow access to the interior of the package. Furthermore, as discussed above, the sidewalls 258, 259 are tapered. Thus, as the slider device 250 is moved from the closed position to the opened position, the first and second hook construction 265, 266 of the slider device 250 engage the first and second shoulders 212, 226 of the first and second closure profiles 201, 213. In so doing, the first and second hook construction 265, 266 aid in separating the first and second closure profiles 201, 213 when the slider device 250 is moved along the resealable closure mechanism 200 from the closed position to the opened position.

The above specification and examples are believed to provide a complete description of the manufacture and use of particular embodiments of the invention. Many embodiments of the invention can be made without departing from the spirit and scope of the invention.

What is claimed is:

1. A flexible package comprising:

(a) a package surrounding wall having a mouth providing access to a package interior;

(b) a resealable closure mechanism along said mouth for selective closing and opening of said mouth; said resealable closure mechanism including first and second closure profiles;

(i) said first closure profile including: a first upper flange; a first closure member having a first catch; said first catch having an upper latching portion and a lower latching portion; and a locking finger extending from said first upper flange;

(ii) said second closure profile including: a second closure member having a second catch; and (iii) said first and second closure profiles being constructed and arranged to interlock; and (c) a slider device operably mounted on said resealable closure mechanism for selectively closing and opening said resealable closure mechanism by moving said slider device to said resealable closure mechanism in opposite first and second directions; said slider device including;

(i) a top wall; said top wall having first and second opposite ends; and (ii) an engagement structure depending from and integral with said top wall; said engagement structure being constructed and arranged to engage said locking finger such that said lower latching portion of said first catch interlocks with said second catch of said second closure member when said slider device is selectively moved along said resealable closure mechanism in said first direction; and (iii) said locking finger is constructed and arranged to engage and interlock with said upper latching portion of said first catch when said engagement structure engages said locking finger.

2. The flexible package according to claim 1, wherein:

(a) said engagement structure is constructed and arranged to engage said locking finger such that said lower latching portion of said first closure member disengages from said second catch of said second closure member when said slider device is selectively moved along said resealable closure mechanism in said second direction.

3. The flexible package according to claim 1, wherein said engagement structure includes:

(a) a first protrusion depending from and integral with said first end of said top wall; said first protrusion depending from said top wall substantially near the center of said top wall; said first protrusion being constructed and arranged for engaging and interlocking said closure members when said slider device is operably mounted on said resealable package and moved in said first direction; and (b) a second protrusion depending from and being integral with said second end of said top wall; said second protrusion being constructed and arranged to engage said locking finger such that said lower latching portion of said first closure member disengages from said second catch of said second closure member when said slider device is selectively moved along said resealable closure mechanism in said second direction.

4. The flexible package according to claim 3, wherein:

(a) said locking finger has a distal end and a proximal end; said proximal end being attached to said first upper flange;

(b) said second protrusion being constructed and arranged to engage said locking finger substantially near the proximal end of the locking finger.

5. The flexible package according to claim 3, wherein:

(a) said locking finger is constructed and arranged to engage and interlock with said upper latching portion of said first catch when said first protrusion engages said locking finger.

6. A reclosable closure mechanism, comprising:

(a) a first closure profile; said first closure profile having a first upper flange; a first closure member having a first catch; a locking finger extending from said first upper flange;

(i) said locking finger being constructed and arranged for engaging and interlocking with said first catch;

(ii) said first catch having an upper latching portion and a lower latching portion;

(b) a second closure profile; said second closure profile having a second catch;

i. said first and second closure profiles being constructed and arranged to interlock; and (c) a slider device operably mounted on said first and second closure profiles for selectively closing and opening said resealable closure mechanism by moving said slider device relative to said resealable closure mechanism in opposite first and second directions; said slider device including:

(i) a top wall; said top wall having first and second opposite ends;

(ii) an engagement structure depending from and integral with said top wall; said engagement structure being constructed and arranged to engage said locking finger such that said lower latching portion of said first catch interlocks with said second catch of said second closure member when said slider device is selectively moved along said resealable closure mechanism in said first direction; and (iii) said locking finger being constructed and arranged for engaging and interlocking with said upper latching portion of said first catch when said engagement structure engages said locking finger.

7. The reclosable closure mechanism according to claim 6, wherein:

(a) said engagement structure is constructed and arranged to engage said locking finger such that said lower latching portion of said first closure member disengages from said second catch of said second closure member when said slider device is selectively moved along said resealable closure mechanism in said second direction.

8. The reclosable closure mechanism according to claim 6, wherein said engagement structure includes:

(a) a first protrusion depending from and integral with said first end of said top wall; said first protrusion depending from said top wall substantially near the center of said top wall; said first protrusion being constructed and arranged for engaging and interlocking said closure members when said slider device is operably mounted on said resealable package and moved in said first direction; and (b) a second protrusion depending from and being integral with said second end of said top wall; said second protrusion being constructed and arranged to engage said locking finger such that said lower latching portion of said first closure member disengages from said second catch of said second closure member when said slider device is selectively moved along said resealable closure mechanism in said second direction.

9. The reclosable closure mechanism according to claim 8, wherein:

(i) said locking finger being constructed and arranged for engaging and interlocking with said upper latching portion of said first catch when said first protrusion engages said locking finger.

10. The reclosable closure mechanism according to claim 8, wherein:

(a) said locking finger having a distal end and a proximal end; said proximal end being attached to said first upper flange;

(b) said second protrusion being constructed and arranged to engage said locking finger substantially near the proximal end of the locking finger.

* * * * *